United States Patent [19]

Keefer

[11] 4,044,744

[45] Aug. 30, 1977

[54] INTERNAL COMBUSTION ENGINE FUEL ECONOMIZER SYSTEM

[76] Inventor: James J. Keefer, 5205 Hillburn Ave., Baltimore, Md. 21206

[21] Appl. No.: 703,772

[22] Filed: July 9, 1976

[51] Int. Cl.[2] ..... F02M 17/14

[52] U.S. Cl. ..... 123/136; 123/129; 123/139 AV

[58] Field of Search ..... 123/139 AV, 136, 129

[56] References Cited

U.S. PATENT DOCUMENTS

| | | | |
|---|---|---|---|
| 650,355 | 5/1900 | Hesse | 123/139 AV |
| 1,196,552 | 8/1916 | La Porte | 123/139 AV |
| 1,323,415 | 12/1919 | Sherbondy | 123/139 AV |
| 1,384,522 | 7/1921 | Eckerle | 123/139 AV |
| 1,424,486 | 8/1922 | Kinzie | 123/139 AV |
| 1,518,906 | 12/1924 | Edwards | 123/139 AV |
| 1,743,582 | 1/1930 | Wiltse | 123/139 AV |
| 1,797,533 | 3/1931 | Stokes | 123/139 AV |
| 1,840,570 | 1/1932 | Dilworth | 123/139 AV |
| 1,847,457 | 3/1932 | Zeibig | 123/139 AV |
| 1,849,590 | 3/1932 | Phillips | 123/139 AV |
| 2,985,161 | 5/1961 | Seegrist | 123/136 |

*Primary Examiner*—Ronald H. Lazarus
*Assistant Examiner*—Daniel J. O'Connor
*Attorney, Agent, or Firm*—J. Gibson Semmes

[57] ABSTRACT

Fuel feed apparatus for internal combustion engine characterized by the coactive disposition of fixed injectors and valves, interposed between fuel tank, pump, and carburetor of the engine. The principal component of the invention comprises plural fixed injectors in the fuel feed line, having the effect of substantially fully atomizing the fuel under control of in-line valves, whereby to feed the carburetor with a prepared mist of fuel under constant pressure thereby creating a substantial economy in the operation of the engine and a great saving in fuel.

2 Claims, 4 Drawing Figures

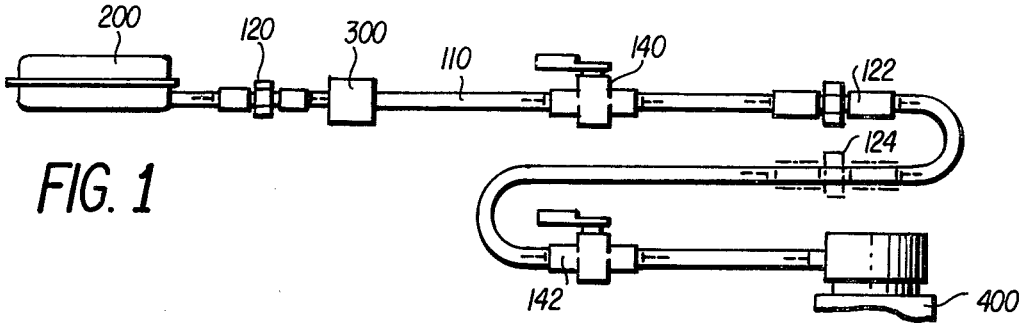
FIG. 1
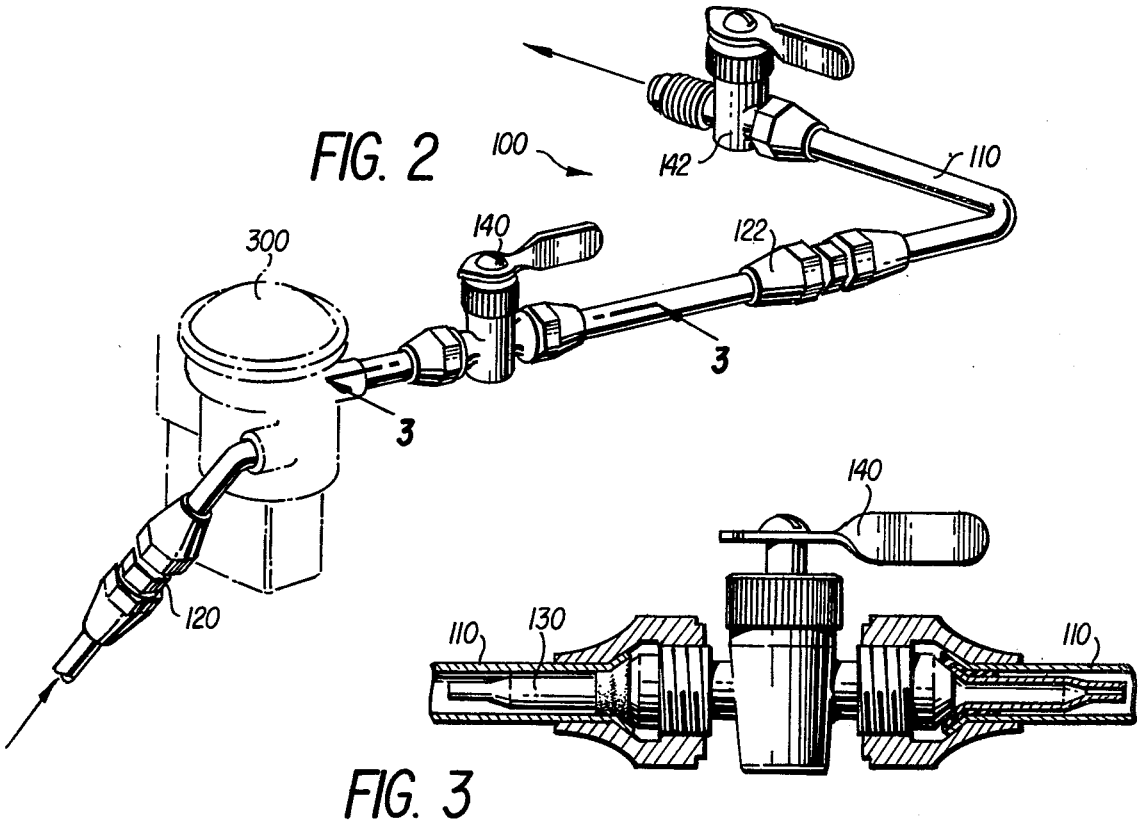
FIG. 2
FIG. 3
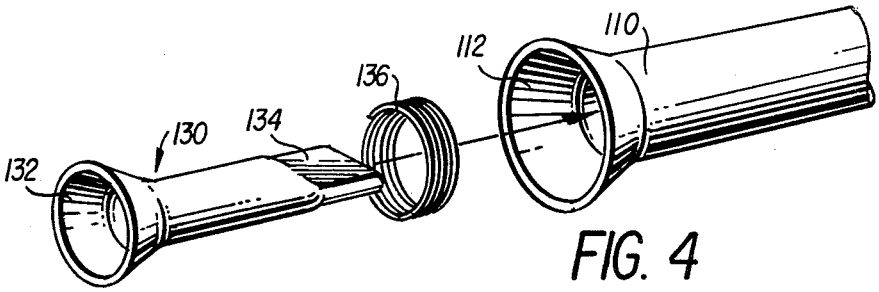
FIG. 4

INTERNAL COMBUSTION ENGINE FUEL ECONOMIZER SYSTEM

BACKGROUND OF THE INVENTION

The prior art is replete with illustrations of the need for creating improved vapor in fuel systems but in each there are disposed highly complex elements to effect the necessary control to avoid excess fuel input. In most, substantial modification to the engine is required and in many, no thought has been given to the development of a compact economizer system which is adapted to the present day, complex automotive engine, having compressors, supplemental accessory power actuators and the like. Noteworthy among the art is the following:

| Number | Date | Name |
|---|---|---|
| 1,218,545 | March 6, 1917 | La Roux B. Giddens |
| 1,660,609 | Feb. 28, 1928 | G. Fornaca |
| 2,285,905 | June 9, 1942 | K. M. Cunningham et al. |
| 2,744,511 | May 8, 1956 | W. M. Kauffmann et al. |
| 3,032,023 | May 1, 1962 | J. Kruger |
| 3,648,674 | Mar. 14, 1972 | Gordon L. Procter |
| 3,667,436 | June 6, 1972 | Robert Reichhelm |
| 3,675,634 | July 11, 1972 | Yasuo Tatsutomi |
| 3,753,424 | Aug. 21, 1973 | Dieter Haidvogel |
| 3,789,820 | Feb. 5, 1974 | Lloyd A. Douglas |
| 3,955,546 | May 11, 1976 | Seth Lee, Jr. |

BRIEF DESCRIPTION OF THE DRAWINGS

FIG. 1 illustrates an adaptation of the invention to a conventional automotive fuel feed system;

FIG. 2 is a view in perspective of the basic components of the invention such as are interposed between the respective fuel reservoir and carburetor of the conventional engine having a one or two barrel carburetor;

FIG. 3 is an expanded view in vertical section of a control valve and associated injectors, taken along the lines 3—3 of FIG. 2;

FIG. 4 is a view in perspective of an expanded injector, its packing and the fuel feed line of the invention described in FIGS. 1-3 inclusive.

DESCRIPTION OF THE PREFERRED EMBODIMENTS

The invention is broadly depicted in FIG. 1 as comprising the system 100, interposed between the respective fuel tank 200, pump 300 and carburetor 400 of a conventional internal combustion engine. System 100 comprises a conventional fuel feed line 110 which for a normal automotive carburetor might be of a diameter of 5/16 inches O.D. and for a heavier automotive vehicle of a diameter of ⅜ inches O.D. It is to such vehicular systems that the invention is particularly designed. Fuel feed line 110 has union 120 interposed between the fuel tank 200 and the pump 300. The function of the union 120 is to accommodate the first of the plural injectors 130, reference FIGS. 3 and 4. Injector 130 is shown in FIG. 4 to have a fluted or conical end 132, said end 132 giving unto the cylindrical shaft and terminating in a substantially flat, constricted orifice at the opposite end 134. As shown in FIG. 1, which is basically illustrative of the inventive system as applied to a one or two barrelled carburetor, the first of the plural injectors is interposed between the output end of the union 120 and the input end of the pump. Said pump may be of any conventional type such as a diaphragm pump currently in use in vehicular engine fuel feed systems. In connection with the output end of the pump 300 via the tubing 110 a first valve 140 is set. Valve 140 includes at its respective input and output ends, one each of the injectors 130, the first of which is reversed in positioning so that the partially vaporized fuel is forced into the narrow opening 134 and dispensed into the valve 140 through the orifice 132; whereas the converse is true on the output end of the said first valve 140. To further accomplish the function of vaporization under the controlled dispensing action of the respective valves there is interposed in the line 110 a second union 122. At the input end there is disposed the injector 130 having its narrow orifice 134 receiving the injected and vaporized fuel and the opposite end 132 feeding into the union to accommodate the first vaporizing effect of the oppositely disposed injector 130 on the output end of the union 122.

With respect to the disposition of the injectors within the fuel feed line, adjacent the respective unions and valves, reference is made to FIG. 3 wherein it will be noted that the fluted end of the injector is adapted to the corresponding opening of the fuel feed line such as it may be connected to either union or valve. The injector is provided with a packing 136 to prevent leakage as the fuel is passed under pressure from one point to another.

For purposes of maintaining a substantially effective feed of the vaporized fuel to the carburetor 400, a second valve 142 is interposed between the said second union and the carburetor. This control valve again compensates for such increases in pressure as may be brought to bear upon the fuel feed lines by virtue of the injectors disposed therein. Adjacent the valve 142 is the same arrangement of injectors on the input and output ends that one finds in FIG. 3.

Lastly, and in the two barrel carburetor system shown in FIG. 1, there is disposed a final injector 130, the output end 132 of which is adjacent the input end of the carburetor.

With respect to the injectors per se, they may be defined as elongated tubes having a funnel opening at one end and a constricted flat orifice at the opposite end, the comparative size thereto varying. In a heavy vehicle system having a ⅜ inch O.D. gas line, the injectors would be of approximately 1-1½ inches in length with an O.D. of ¼ inch and flaring at the funnel end of approximately 5/16 inch. In the lighter vehicle gas line having a 5/16 outer diameter, the size of the spray injectors would be substantially the same in length but of smaller 3/16 inch O.D., flaring to ¼ inch at the funnel and constricted ends respectively. In number, for the lighter double-barrelled carburetor, there are a total of eight injectors. For the heavier vehicle, I have found it satisfactory to incorporate ten of the said injectors and an additional union, as aforesaid. Whereas the dimensional relationship between injectors and fuel line has been described with reference to conventional automotive fuel systems, it will be apparent that variation in size of the component injectors, unions and valves will be desirable, depending upon various engine requirements.

It will be apparent from the aforementioned that the total number of injectors and unions in a conventional internal combustion engine fuel feed system, will depend upon carburetor requirement. For example, reference FIG. 1, in a four-barrelled carburetor such as one now finds in the internal combustion engines of heavy vehicles, it is desirable to include in addition to the union 122, a second union and accompanying input and output injectors 130 as illustrated in phantom line in FIG. 1.

Many of today's vehicles are manufactured with an electric fuel pump in the gas tank. For such lighter vehicles, I propose to include seven injectors only, two valves and one union. Reference FIG. 1, the first union and accompanying valves would therefor be dispensed with and the overall system will function substantially the same, assuming careful control of the valves is undertaken.

The functioning of the system is quite simple. The interaction between the fixed injectors 130 and the control valves 140–142 is such as to provide to the carburetor a vaporized fuel which is pressured-controlled. The carburetor is permitted to function with the atomized or vaporized fuel feed to it at the same general operating pressure as is conventional. Thus, virtually no modification to the existing internal combustion engine is required to establish the desired objective, save perhaps a minor carburetor adjustment to compensate for the vapor fluid input.

I claim:

1. In combination with an internal combustion engine, fuel feed economizer apparatus, adapted to a gas line leading from a fuel tank to the carburetor comprising:

A. a fuel line joining tank to carburetor;

B. plural injectors sealed within the fuel line, between the tank and the carburetor, each said injector having a fluted orifice end of expanded circular cross-section and a restricted orifice end of substantially elongate cross-section;

C. plural control valves interposed between the said tank and carburetor, there being one each injector disposed with the fluted end of each said injector adjacent the respective input and output ends of the valves; and D. at least one union disposed between the valves, said union having injectors with the fluted end of each said injector adjacent input and output ends of the union.

2. The apparatus of claim 1 further including:

a fuel pump within the fuel line between the tank and carburetor;

an auxiliary union within the fuel line between the tank and the pump, said auxiliary union spacing two injectors with the fluted end of each said injector secured adjacent input and output ends of the union.

* * * * *